US006053806A

United States Patent [19]

Ohlendorf

[11] Patent Number: 6,053,806

[45] Date of Patent: Apr. 25, 2000

[54] SUCTION DEVICE FOR A HAND-HELD TOOL

[75] Inventor: Oliver Ohlendorf, Munich, Germany

[73] Assignee: Hilti Aktiengesellschaft, Schaan, Liechtenstein

[21] Appl. No.: 09/188,879

[22] Filed: Nov. 9, 1998

[30] Foreign Application Priority Data

Nov. 13, 1997 [DE] Germany ..... 197 50 283

[51] Int. Cl.[7] ..... B24B 55/06

[52] U.S. Cl. ..... 451/456; 451/442; 451/451

[58] Field of Search ..... 451/451, 452, 451/455, 456, 457, 359, 358, 442; 15/327.3, 378, 385, 422; 83/168, 860; 30/390, 516

[56] References Cited

U.S. PATENT DOCUMENTS

| | | | |
|---|---|---|---|
| 1,951,105 | 3/1934 | Myers . | |
| 3,068,620 | 12/1962 | Tocci-Guilbert | 451/451 |
| 3,148,488 | 9/1964 | Reaser | 451/455 |
| 3,172,831 | 3/1965 | Williams | 451/455 |
| 3,673,744 | 7/1972 | Oimoen . | |
| 4,099,328 | 7/1978 | Schlemmer . | |
| 4,965,966 | 10/1990 | Braasch . | |
| 5,388,305 | 2/1995 | Fields | 15/385 |
| 5,411,433 | 5/1995 | Keller | 451/451 |
| 5,527,207 | 6/1996 | Azar et al. | 451/451 |
| 5,709,597 | 1/1998 | Sarantitis | 451/451 |
| 5,711,051 | 1/1998 | Roden | 15/385 |
| 5,713,785 | 2/1998 | Nishio | 451/451 |
| 5,766,062 | 6/1998 | Edling | 451/451 |

FOREIGN PATENT DOCUMENTS 2712835 11/1993 France .

*Primary Examiner*—Derris Holt Banks
*Attorney, Agent, or Firm*—Brown & Wood, LLP

[57] ABSTRACT

A suction device for a hand-held tool having a plate-like working tool, the section device including a hood-shaped housing covering a rear side of the tool (4) and partially a working tool circumference and connectable with a device for creating vacuum, and a protective screen (3) formed of a flexible material and extending along a circumference of a free end surface of the housing (2) and projecting axially above the free end surface, with the protective screen (3) having a plurality of slots (31) distributed along a circumferential extent of the protective screen (3) and opening toward a free end of the protective screen (3).

9 Claims, 1 Drawing Sheet

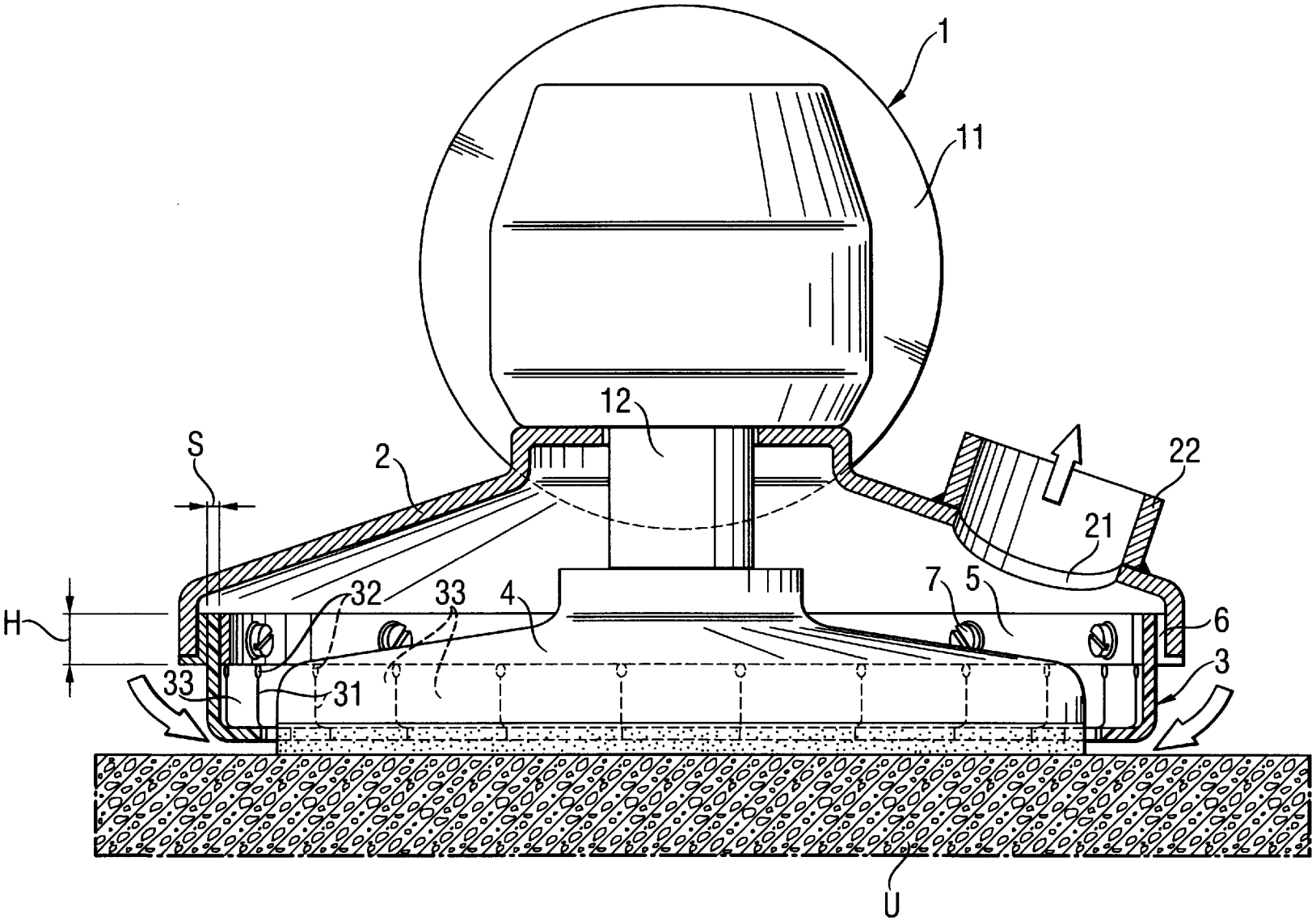
1
11
22
21
6
3
5
7
U
12
4
33
2
32
31
S
33
H

SUCTION DEVICE FOR A HAND-HELD TOOL

BACKGROUND OF THE INVENTION

1. Field of the Invention

The present invention relates to a suction device for a hand-held tool having a plate-like working tool, and including a hood-shaped housing covering a rear side of the working tool and partially a working tool circumference and connectable with a device for creating vacuum, and a protective screen formed of a flexible material and extending along a circumference of a free end surface of the housing, projecting axially above the free end surface.

2. Description of the Prior Art

Dust, which is formed during treatment of the structural components with conventional hand-held tools, in particular with grinders, is aspirated from the work location by a suction device and is delivered to a collector. One of such hand-held tools formed as an angular grinder is disclosed in a French Publication No. 2,712,835. The suction device of this angular grinder has a hood-shaped housing which surrounds a circumferential region of the plate-like working tool of the angular grinder which tool is formed as a grinding wheel. The hood-shaped housing is secured to the housing of the angular grinder.

At a free, in the working direction, end of the suction device housing, there is provided a protective screen which projects above the housing free end and so seals the housing inner space from the surrounding environment that a vacuum can be created in the housing inner space by vacuum generating means. The protective screen is formed of a strip made of a flexible elastic material and bent into a ring. A certain air volume, which is aspirated by the vacuum generating device from the housing through an outlet opening, is aspirated from outside into the housing interior through a suction cross-section. The suction cross-section is formed by an intermediate space between the protective screen and the structural component, which intermediate space is formed when a non-worn grinding wheel abuts the structural component.

During treatment of the structural component, the grinding wheel wears off, and the protective screen contacts the structural component. This reduces the suction cross-section, and the protective screen becomes subjected to wear. The reduction of the suction cross-section results in increased vacuum in the housing interior, and the housing becomes attached to the structural component more and more. This results, in turn, in that the grinding wheel is pressed more strongly to the structural component which leads to a more rapid wear-off of the grinding wheel. As a result of this, the displacement of the grinding wheel over the structural component becomes more difficult, and the load on the drive motor of the grinder greatly increases.

Accordingly, an object of the present invention is to provide a suction device the protective screen of which is not subjected to wear, and an adequate size of the suction cross-section is insured.

SUMMARY OF THE INVENTION

This and other objects of the present invention, which will become apparent hereinafter, are achieved by providing in the protective screen a plurality of slots distributed along a circumferential extent of the protective screen and opening toward a free end of the protective screen. The slots divide the free end of the protective screen into a plurality of sections arranged next to each other and which become deflected or turned up toward the interior or the inner space of the housing under the action of an air volume which flows into the housing through the suction cross-section. Thereby, an adequate size of the suction cross-section is maintained.

For manufacturing reasons, the slot preferably extend substantially perpendicular to the circumferential extent of the protective screen.

In order to insure that the sections of the protective screen, which are formed by the slots, turn up more easily, the slots extend, at least partially, over the entire height of the protective screen.

In order to provide for a uniform distribution of air, which is aspirated into the housing, over the circumference of the protective screen, preferably from two to fifty slots are uniformly distributed over the circumference of the protective screen.

A constant width of the slots or a constant distance between the sections of the protective screen over the circumferential extent of the protective screen will be achieved while, preferably, the slot width, measured in the circumferential direction, diminishes toward the free end of the protective screen. The slot width can be reduced, e.g., by rounding the separate sections in the transitional region between the slots and the respective free ends of the separate sections, with the rounding radius corresponding at most to the slot length.

The separate sections, can, e.g., taper in the circumferential direction of the protective screen, toward the free end of the sections. Thereby, there are provided slots which conically widen toward the free ends of the separate sections.

When separate sections are turned up toward the housing interior, then the slot width or the distance between separate sections in the circumferential direction of the protective screen is reduced. In order to prevent the sections from mutually interfering with each other during turning up, the smallest width, which is measured in the circumferential direction of the protective screen, should amount from 0 to about 3 mm.

The sections of the protective screen constantly move during the treatment of the structural component. In order to prevent that the section movement does not result in tear of the protective screen in the base region of the slots, the slots, preferably, open into respective radial openings formed in the protective screen and the diameter of which overlaps the width of respective slots in the mouth regions of the radial openings.

In order to prevent the transitional region between separate sections and the remaining portion of the protective screen from weakening, the diameter of the radial openings should amount from about 0.2 mm to about 5 mm. As discussed above, the diameter of the radial openings is larger than the width of the slots.

Good elastic behavior of separate sections of the protective screen is achieved when, advantageously, the protective screen is formed of an elastomeric material.

BRIEF DESCRIPTION OF THE DRAWINGS

The features and objects of the present invention will become more apparent, and the invention itself will be best understood from the following detailed description of the preferred embodiment when read with reference to the accompanying drawings, wherein:

Single Figure shows a cross-sectional view of a suction device according to the present invention.

DETAILED DESCRIPTION OF THE PREFERRED EMBODIMENT

An angular grinder 1, which is only hinted in the drawing, includes a drive motor located in the housing 11 and the rotational movement of which is transmitted via an angular gear to a driven shaft 12. Both the drive motor and the angular gear are not shown in the drawing. A plate-like working tool, which is formed as a grinding wheel 4, is secured on the free end of the driven shaft 12 projecting from the housing 11. The grinding wheel 4 abuts a structural component 4 and, performing a rotational movement, carries away small particles from the structural component 4. A suction device is provided on the grinder housing 11 in the region of the angular gear. The suction device includes a hood-shaped housing 2, which covers the grinding wheel 4 and is arranged coaxially therewith, and a protective screen 3. The housing 2 has a conical shape, widening from its attachment region in the area of the angular gear towards its free end lying opposite to its attachment region. The housing 2 has an outlet opening 21 in its conical region. The outlet opening 21 opens into a connection union 22 secured in the outer wall of the housing 2. The connection union 22 is connected with a device for creating vacuum in the working region of the grinding wheel or in the inner space of the housing 2, and with a collecting tank for the particles carried away from the structural component U. Both the vacuum creating device and the collecting tank are not shown in the drawings. The vacuum creating device can be formed, e.g., as an external suction apparatus having a hose conduit securable on the connection union 22.

The protective screen 3 has a connection region extending into the housing 2 and is formed of a strip-shaped annular clastomer member. The connection region of the protective screen 3 is secured in the free end region of the housing 2 with fit into each other clamping ring 5, 6 and screw-shaped attachment elements 7. Both clamping rings 5, 6 have, in a direction parallel to the longitudinal axis of the housing 2, a height H.

The protective screen has a plurality of slots 31 extending substantially parallel to the longitudinal axis of the housing 2 and which open at the free end of the protective screen 3. The slots 31 divide a portion of the protective screen 3 in a plurality of elastic sections 33 arranged one after another along the circumference of the screen 3. The sections 33 are deflected slightly toward the inner space of the housing 2 by an air stream, which is indicated with a thick arrow and which is generated by the external vacuum creating device. The lots 31 open into radially extending openings 32 having a diameter from about 0.2 mm to about 5 mm.

The thickness of the protective screen 3 amounts from about 0.2 mm to about 3 mm.

Though the present invention was shown and described with references to the preferred embodiments, various modifications thereof will be apparent to those skilled in the art and, therefore, it is not intended that the invention be limited to the disclosed embodiments or details thereof, and departure can be made therefrom within the spirit and scope of the appended claims.

What is claimed is:

1. A suction device for a hand-held tool having a working tool (4), comprising a hood-shaped housing covering a rear side of the tool (4) the housing comprising and a working tool circumference and connectable with a device for creating vacuum; and a protective screen (3) formed of a strip made of a flexible material bent into a ring extending along a circumference of a free end surface of the housing (2), and projecting axially above the free end surface, the protective screen (3) having a plurality of slots (31) distributed along a circumferential extent of the protective screen (3) and opening toward a free end of the protective screen (3), the protective screen (3) has a plurality of radial openings (32), wherein the slots (31) open into respective radial openings (32), and wherein each opening (32) has a diameter which extends beyond the width of a respective slot (31) in a mouth region thereof.

2. A suction device according to claim 1, wherein the slots (31) extend substantially perpendicular to the circumferential extent of the protective screen (3).

3. A suction device according to claim 1, wherein the slots (31) extend at least partially over an entire height of the protective screen (3).

4. A suction device according to claim 1, wherein the protective screen is formed of an elastomeric material.

5. A suction device for a hand-held tool having a plate-like working tool (4), comprising a hood-shaped housing covering a rear side of the tool (4) and partially a working tool circumference and connectable with a device for creating vacuum; and a protective screen (3) formed of a flexible material and extending along a circumference of a free end surface of the housing (2) and projecting axially above the free end surface, the protective screen (3) having a plurality of slots (31) distributed along a circumferential extent of the protective screen (3) and opening toward a free end of the protective screen (3), wherein the plurality of slot comprises from 2 to 50 slots (31) uniformly distributed over a circumference of the protective screen (3), the protective screen (3) has a plurality of radial openings (32), wherein the slots (31) open into respective radial openings (32), and wherein each opening (32) has a diameter which extends beyond the width of a respective slot (31) in a mouth region thereof.

6. A suction device for a hand-held tool having a plate-like working tool (4), comprising a hood-shaped housing covering a rear side of the tool (4) and partially a working tool circumference and connectable with a device for creating vacuum; and a protective screen (3) formed of a flexible material and extending along a circumference of a free end surface of the housing (2) and projecting axially above the free end surface, the protective screen (3) having a plurality of slots (31) distributed along a circumferential extent of the protective screen (3) and opening toward a free end of the protective screen (3), wherein each slot has a width measured in a circumferential direction and which diminishes toward the free end of the protective screen, the protective screen (3) has a plurality of radial openings (32), wherein the slots (31) open into respective radial openings (32), and wherein each opening (32) has a diameter which extends beyond the width of a respective slot (31) in a mouth region thereof.

7. A suction device according to claim 6, wherein a smallest magnitude of the width amounts from 0 to about 3 mm.

8. A suction device according to claim 6, the protective screen (3) has a plurality of radial openings (32), wherein the slots (31) open into respective radial openings (32), and wherein each opening (32) has a diameter which extends beyond the width of a respective slot (31) in a mouth region thereof.

9. A suction device according to claim 6, wherein the radial openings (32) have a diameter from about 0.2 mm to about 5 mm.

* * * * *